US012075868B2

(12) United States Patent
Riquetti et al.

(10) Patent No.: US 12,075,868 B2
(45) **Date of Patent: *Sep. 3, 2024**

(54) SLEEVE FOR A GARMENT

(71) Applicant: LULULEMON ATHLETICA CANADA INC., Vancouver (CA)

(72) Inventors: Jessica Cecilie Riquetti, North Vancouver (CA); Clémentine Geneviève Jacqueline Renaud, Vancouver (CA)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/105,809

(22) Filed: Feb. 4, 2023

(65) Prior Publication Data

US 2023/0180869 A1 Jun. 15, 2023

Related U.S. Application Data

(63) Continuation of application No. 16/877,813, filed on May 19, 2020, now Pat. No. 11,596,189.

(60) Provisional application No. 62/857,237, filed on Jun. 4, 2019.

(51) Int. Cl.
*A41D 27/10* (2006.01)
*A41D 31/06* (2019.01)

(52) U.S. Cl.
CPC ..... *A41D 27/10* (2013.01); *A41D 31/065* (2019.02)

(58) Field of Classification Search
CPC ..... A41D 27/10; A41D 31/065; A41D 27/24; A41D 27/02
See application file for complete search history.

(56) References Cited

U.S. PATENT DOCUMENTS

| | | | |
|---|---|---|---|
| 359,052 | A | 3/1887 | Bölen |
| 931,249 | A | 8/1909 | Barker |
| 931,711 | A | 8/1909 | Hochstuhl |
| 1,575,562 | A | 3/1926 | Feiss |
| 1,761,886 | A | 6/1930 | Haspel |
| 1,784,285 | A | 12/1930 | Heaton |
| 2,313,519 | A | 3/1943 | Cuttler |
| 2,327,348 | A | 8/1943 | Giuseffi |
| 2,558,533 | A | 6/1951 | Bell |
| 2,670,471 | A | 3/1954 | Kaufman |

(Continued)

OTHER PUBLICATIONS www.meriam-webster.com/dictionary/cuff Definition of the term "cuff". (Year: 2023).*

*Primary Examiner* — Alissa L Hoey
(74) *Attorney, Agent, or Firm* — CONNEELY PC; Joseph Conneely

(57) ABSTRACT

Examples of a sleeve for a garment are disclosed. The sleeve comprises an outer panel attached along respective side edges thereof to form an outer sleeve and an inner panel attached along respective side edges thereof to form an inner liner of the sleeve. The inner liner and the outer sleeve are attached at least along respective edges of their respective lower ends forming a hand opening. An elastic band is attached to the inner liner proximate a wrist area of the sleeve and is spaced apart from the outer sleeve. The elastic band is configured to draw the inner liner into contact with and hug a wrist area of the wearer while the outer layer is loosely fitted around the wrist area of the wearer.

10 Claims, 4 Drawing Sheets

(56) References Cited

U.S. PATENT DOCUMENTS

| | | | | | |
|---|---|---|---|---|---|
| 2,675,554 | A | | 4/1954 | Gertz | |
| 2,928,101 | A | | 3/1960 | Kennedy | |
| 3,114,915 | A | | 12/1963 | Gross | |
| 3,214,771 | A | | 11/1965 | Treiber | |
| 3,671,975 | A | | 6/1972 | Vorsteher | |
| 3,742,518 | A | | 7/1973 | Garcia | |
| 4,194,248 | A | | 3/1980 | Verschaeve | |
| 4,543,670 | A | * | 10/1985 | Ehring | A41D 27/10 2/124 |
| 4,631,753 | A | * | 12/1986 | Ehring | A62B 17/003 2/124 |
| 4,733,412 | A | | 3/1988 | Campbell | |
| 4,734,306 | A | | 3/1988 | Lassiter | |
| 4,860,386 | A | | 8/1989 | Martin | |
| 5,208,919 | A | | 5/1993 | Fields | |
| 5,388,270 | A | * | 2/1995 | Hewitt | A62B 17/001 2/81 |
| 5,504,944 | A | | 4/1996 | Bromer et al. | |
| 6,079,343 | A | | 6/2000 | Wong | |
| 6,687,913 | B2 | | 2/2004 | Aldridge | |
| 6,797,352 | B2 | | 9/2004 | Fowler | |
| 6,983,490 | B1 | | 1/2006 | Lewis et al. | |
| 7,191,720 | B2 | | 3/2007 | Thomas | |
| 7,455,743 | B2 | | 11/2008 | Kramer et al. | |
| 8,726,415 | B2 | | 5/2014 | Grilliot et al. | |
| 8,782,812 | B2 | | 7/2014 | Bansal et al. | |
| 10,874,155 | B2 | | 12/2020 | Schierenbeck et al. | |
| 11,077,324 | B2 | * | 8/2021 | Barbeau | A41D 27/24 |
| 11,596,189 | B2 | | 3/2023 | Riquetti et al. | |
| 2003/0079272 | A1 | | 5/2003 | Poppe | |
| 2003/0172433 | A1 | | 9/2003 | Young | |
| 2005/0022285 | A1 | | 2/2005 | Berns et al. | |
| 2005/0061331 | A1 | | 3/2005 | Cheung | |
| 2005/0229283 | A1 | | 10/2005 | Towle et al. | |
| 2006/0041989 | A1 | | 3/2006 | Bushman | |
| 2008/0034466 | A1 | | 2/2008 | Zicarelli | |
| 2011/0119811 | A1 | | 5/2011 | Rock et al. | |
| 2013/0086730 | A1 | | 4/2013 | Wilkening et al. | |
| 2013/0318680 | A1 | | 12/2013 | Keathley | |
| 2018/0098590 | A1 | | 4/2018 | Turner | |
| 2018/0255883 | A1 | | 9/2018 | Brandt et al. | |
| 2018/0338543 | A1 | | 11/2018 | Robertson | |
| 2018/0352878 | A1 | | 12/2018 | Smith | |
| 2020/0237037 | A1 | | 7/2020 | Leung | |
| 2021/0161231 | A1 | | 6/2021 | Ascencio | |
| 2021/0177077 | A1 | | 6/2021 | Clark et al. | |
| 2021/0213323 | A1 | | 7/2021 | Trebino | |

* cited by examiner

SLEEVE FOR A GARMENT

This application is a continuation of U.S. patent application Ser. No. 16/877,813, filed May 19, 2020, which claims priority from and the benefit of the filing date of U.S. Provisional Patent Application No. 62/857,237, filed Jun. 4, 2019, and the entire content of such applications is incorporated herein by reference.

TECHNICAL FIELD

The present disclosure relates to the field of garments, and more specifically, to a sleeve for an outerwear garment having an elastic band located proximate a wrist area of the sleeve.

BACKGROUND

Outerwear, such as jackets, are usually worn in cold or rainy weather. In a typical sports jacket, for example, a cuff is attached to a lower end of each sleeve to provide a snug fit against the wrists of a wearer to block pathways for the entry of weather elements (e.g., moisture, cold air, etc.) into the interior of the jacket. Typically, cuffs used in outerwear are made separately from the sleeve (e.g., from an elastic material) and are then attached to the lower end of the sleeve by, for example, sewing. Therefore, a seam is typically formed between the sleeve and the cuff. Problematically, the elements can penetrate through such seams into the interior of the sleeve. In addition, such cuffs may fit tightly against the wearer's arms (e.g., at the wrists) and may interfere with easy removal of the garment. In some outerwear, the cuffs are omitted or are loose fitting and additional fasteners (e.g., snap buttons, zippers, VELCRO' straps) can be added to the outer layer of the sleeve (around the wrist area) to tighten the sleeve against the wrist to prevent the elements entering the interior of the garment. However, such additional fasteners may be inconvenient for the wearer since they require additional time to fasten and unfasten each time the wearer puts on or takes off the garment. Typically, in garments known in the prior art, the sleeve cuff is attached to either both the outer and inner panels of the sleeve or to only the inner liner of the sleeve by sewing. As such, the sleeve cuff is still a separate component that is constructed by cutting and sewing, in addition to the construction of the sleeve itself, which increases the time needed for sleeve construction as well as increasing fabric wastage.

SUMMARY

In one aspect, a sleeve for a garment is provided. The sleeve comprises an outer panel attached along respective side edges thereof to form an outer sleeve and an inner panel attached along respective side edges thereof to form an inner liner of the sleeve. The inner liner and the outer sleeve are attached at least along respective edges of their respective lower ends forming a hand opening. An elastic band is attached to the inner liner away from the hand opening proximate a wrist area of the sleeve. The elastic band is spaced apart from the outer sleeve such that in use, the elastic band draws the inner liner into contact with to the wrist area of the wearer while the outer layer remains loose and cuffless.

In addition to the aspects and embodiments described above, further aspects and embodiments will become apparent by reference to the drawings and study of the following detailed description.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the disclosure. Sizes and relative positions of elements in the drawings are not necessarily drawn to scale. For example, the shapes of various elements and angles may be not drawn to scale, and some of these elements may be arbitrarily enlarged and positioned to improve drawing legibility.

DETAILED DESCRIPTION OF EXAMPLE EMBODIMENTS

The present disclosure discloses an article of apparel, such as a garment, that is configured to protect the wearer against the elements, e.g., cold, moisture, wind, etc. The garment has two sleeves attached at respective arm openings formed on each side of a torso portion of the garment to cover the wearer's arms. Each sleeve further comprises an elastic band configured to provide a snug fit around the wrist area of the wearer to prevent or reduce the elements from penetrating into the interior of the garment through the hand opening. The elastic band is attached (or connected) only to the inner liner of the sleeve at a distance away from the hand opening while it is separated from the outer sleeve, so that the outer sleeve is fixed and undisturbed (i.e., is not drawn toward the wearer's wrist) and can be seamless at least around the wrist area. The elastic band can be attached to the inner liner either on its inner face (i.e., facing the wearer's arm) or to its outer face (i.e., facing the outer sleeve) without departing from the scope of the disclosure. The elastic band can be attached to the inner liner by sewing, bonding, or the like.

Figure 1:
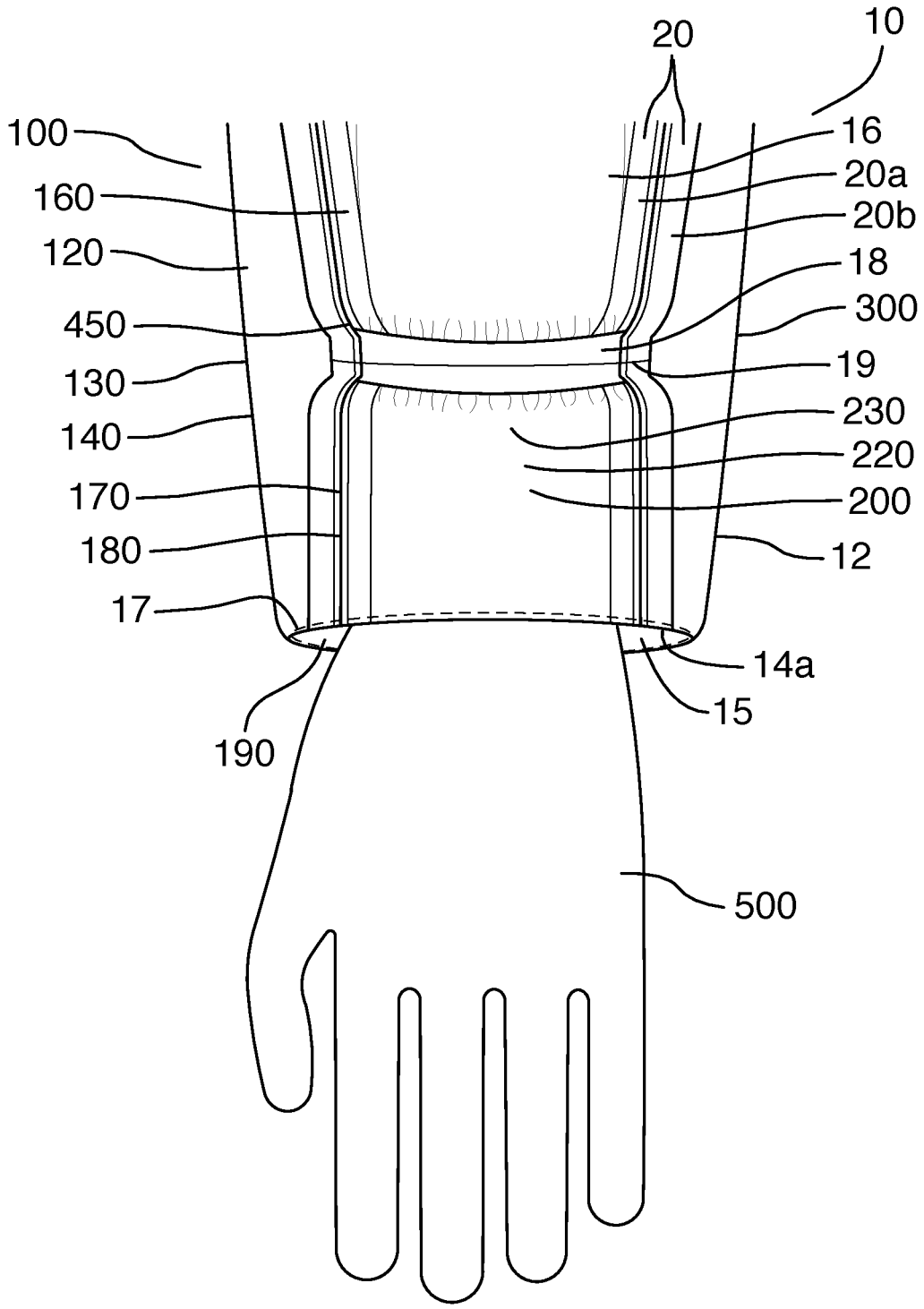
FIG. 1 is a partial x-ray view of an example of a sleeve for a garment showing a lower end of the sleeve and an elastic band attached to an inner liner of the sleeve to provide a snug fit for a portion of the inner liner against the wrist area of a wearer.
Figure 2:
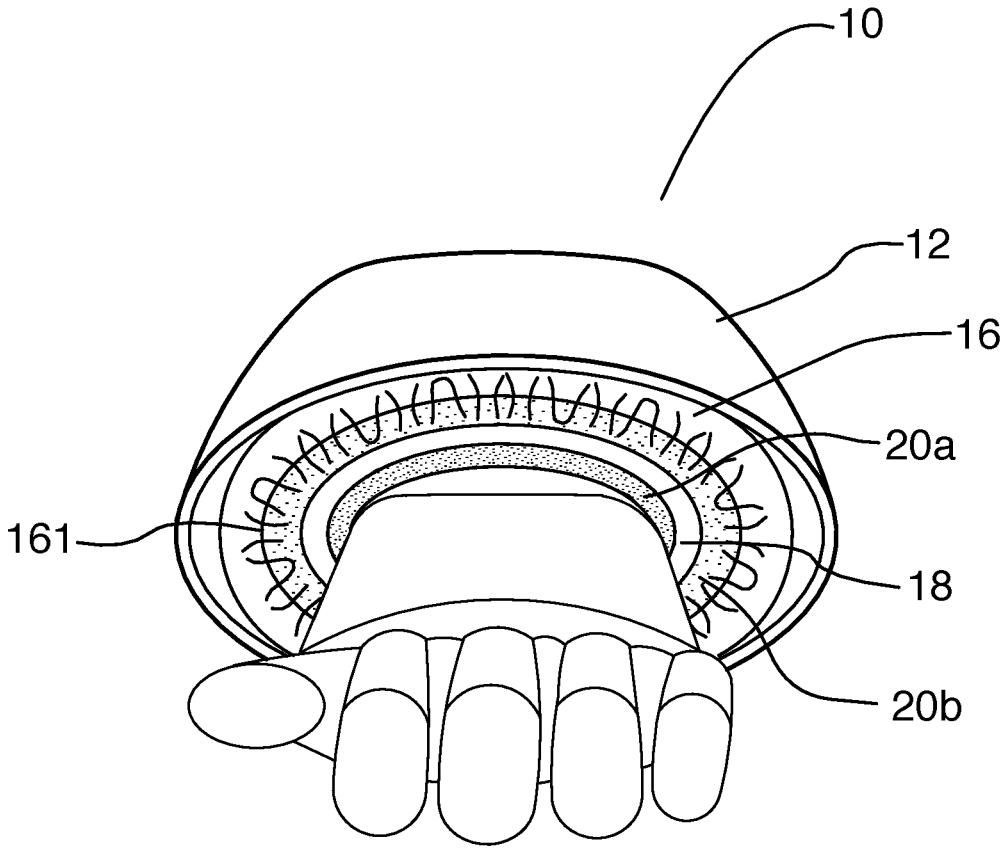
FIG. 2 is a cut-out bottom view of an example of a sleeve for a garment showing the sleeve's inner components.
Figure 3:
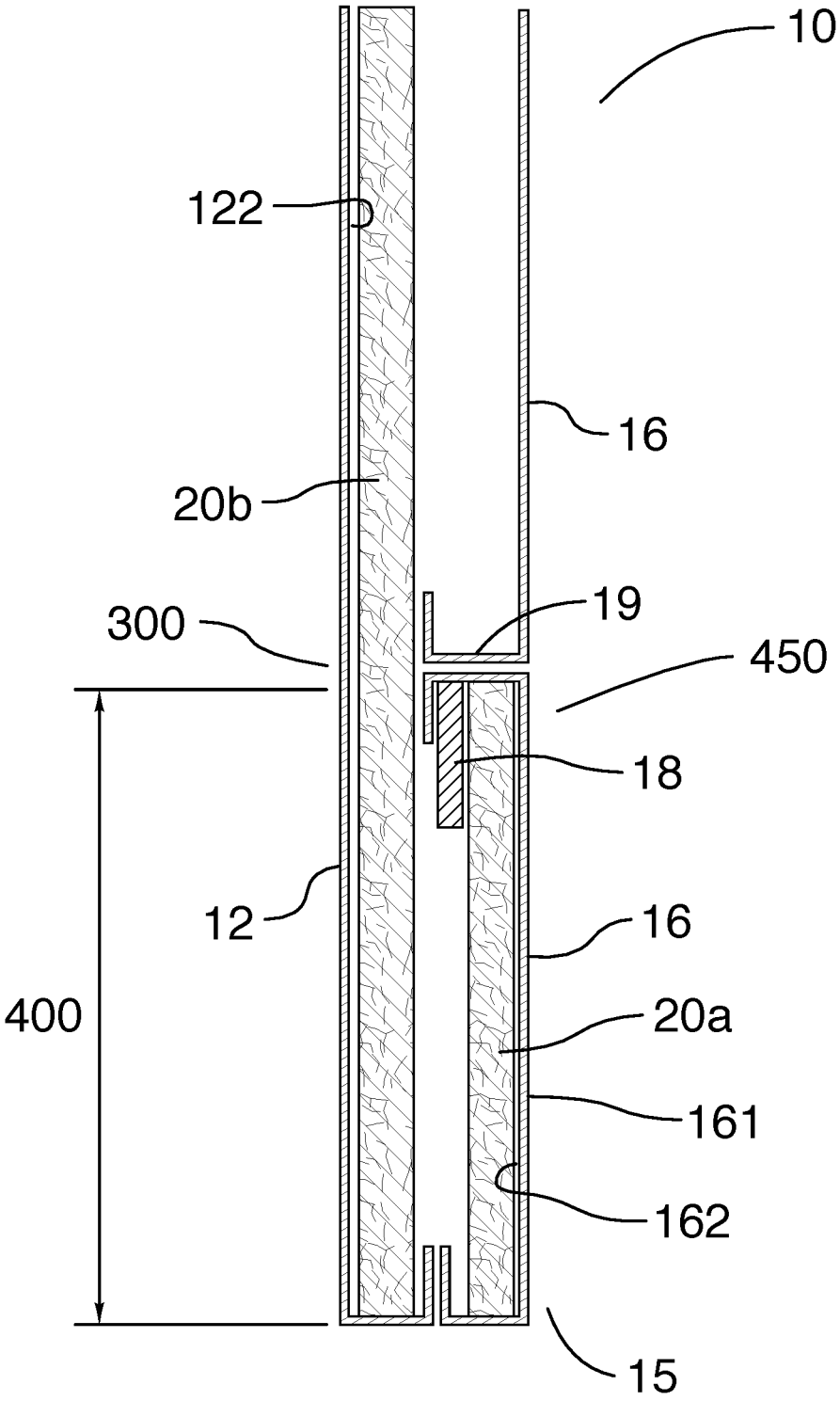
FIG. 3 is a cross-sectional view of a portion of a sleeve for a garment showing an outer sleeve of the sleeve, an inner liner of the sleeve, and an elastic band attached to the inner liner.
Figure 4:
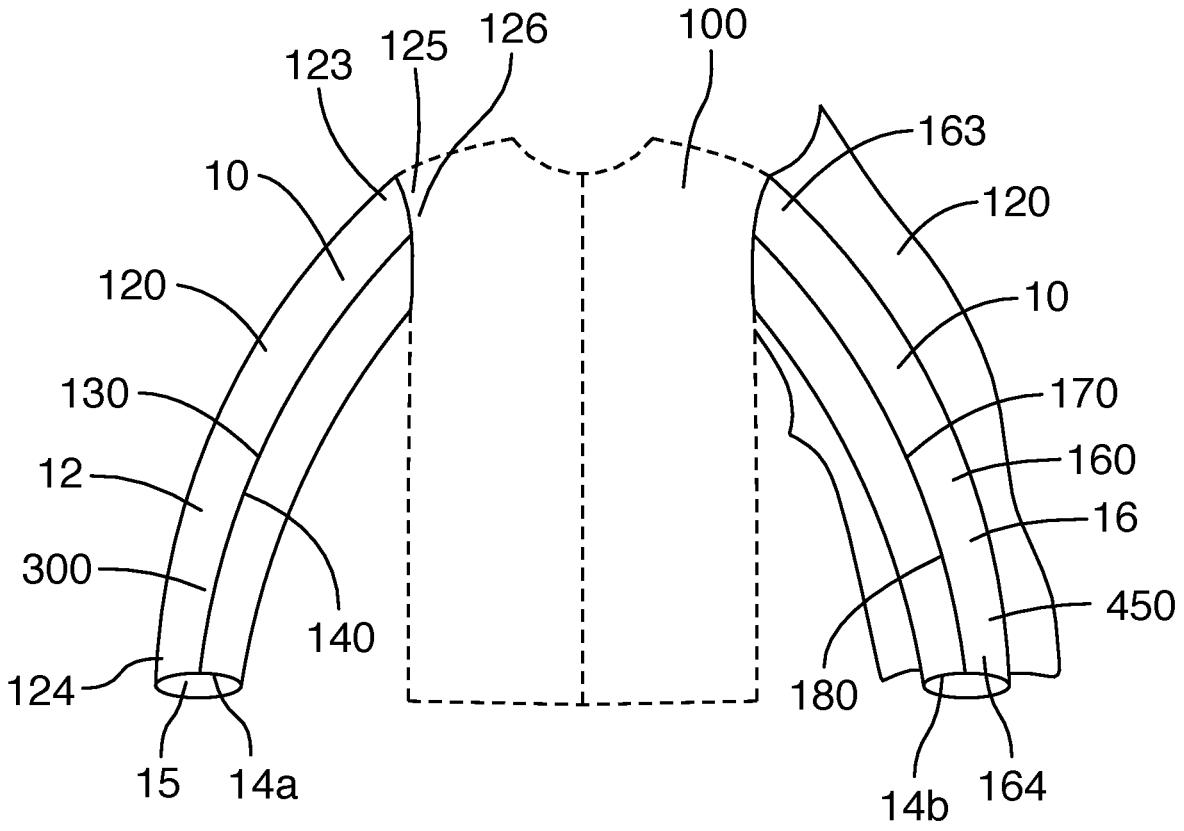
FIG. 4 is a front view of an example garment with the outer panel of the left sleeve of the garment shown unattached at its side edges to expose the inner panel of the sleeve.

FIG. 1 is a partial x-ray view illustrating a sleeve 10 for a garment 100. And, FIG. 4 is a front view of the garment 100 with the outer panel 120 of the left sleeve of the garment 100 shown unattached at its side edges 130, 140 to expose the inner panel 160 of the sleeve 10. Note that only a portion of the sleeve 10 of the garment 100 is illustrated in FIGS. 1-3 for clarity. The garment 100 can be an outerwear garment, such as a sports jacket. The sleeve 10 has an outer panel 120 attached along side edges 130, 140 thereof forming an outer sleeve 12 having a lower edge 14*a*. The lower edge 14*a* forms a hand opening 15 for the sleeve 10. The outer sleeve 12 has an upper end 123 having an upper opening 125 which is attached to a respective arm opening 126 of the garment 100. The sleeve 10 further comprises an inner panel 160 having an upper end 163 and a lower end 164 and is attached along its side edges 170, 180 to form an inner liner 16 of the sleeve 10. In one embodiment, the outer sleeve 12 and the inner liner 16 are attached along at least their respective lower edges 14*a*, 14*b*. For example, the outer sleeve 12 and the inner liner 16 can be attached together by sewing (e.g., by understitching 17 to attach the outer sleeve 12 and the inner liner 16). An elastic band 18 is attached to the inner liner 16 on either the outer face 161 of the inner liner 16 facing the outer sleeve 12 or on the inner face 162 of the inner liner 16 facing the wearer's arm 200. The elastic band 18 is not in contact with the outer sleeve 12 so that the outer sleeve 12 can appear loose and cuffless. The outer sleeve 12 can be formed with no seams in the wrist area 300 through which the elements can penetrate. Any seams that may appear in the wrist area 300 of the outer sleeve 12 can be for decorative purposes only. The elastic band 18 is attached to the inner liner 16 at a distance 400 from the hand opening 15 and is configured to provide a snug fit for a portion 450 of the inner liner 16 against the wearer's arm 200 in the wrist area 230. Thus, the inner liner 16 fits closely against the arm 200 of the wearer 500 to prevent or reduce the elements from penetrating into the interior 190 of the sleeve 10 and garment 100. The elastic band 18 can be added to the inner liner 16 without the need to cut the inner liner 16. In this way, the inner liner 16 can be seamless as well. The elastic band 18 can be attached to the inner liner 16 by sewing, gluing (bonding), or the like. In one embodiment, the inner liner 16 can have an inside seam 19 to position and fix the elastic band 16 in place.

The at least one insulation layer 20 can provide extra protection against the elements. The at least one insulation layer 20 can be positioned between the outer sleeve 12 and the inner liner 16. As illustrated in FIG. 1, the sleeve 10 can have a first insulation layer 20*a* positioned between the inner liner 16 and the elastic band 18 so as to provide a soft and gentle feeling against the wearer's skin when the elastic band 18 draws the inner liner 16 in to hug the wrist 220 of the wearer 500. A second insulation layer 20*b* can be attached to an inner surface 122 of the outer sleeve 12.

FIG. 2 is a cut-out bottom view of the sleeve 10 showing the inner components of the sleeve 10. In the illustrated embodiment of FIG. 2, the inner liner 16 of the sleeve 10 faces the outer sleeve 12 with no insulation layer in between. The inner liner 16 and the outer sleeve 12 are attached only at their lower ends 124, 164 along the periphery edges 14*a*, 14*b* at the hand opening 15, such that the inner liner 16 is separated from the outer sleeve 12. An insulation layer 20*b* is attached to an inner face (i.e., facing the wearer) 161 of the inner liner 16 and an elastic band 18 is attached to the insulation layer 20*b* and through the insulation layer 20*b* to the inner liner 16 as well. Another insulation layer 20*a* can be added on the other side of the elastic band 18 so that the elastic band 18 is sandwiched between the two insulation layers 20*a*, 20*b*.

FIG. 3 is a cross-sectional view of a portion of the sleeve 10 showing the concentric outer sleeve 12, inner liner 16, and elastic band 18 that is positioned between the two insulation layers 20*a*, 20*b*. The elastic band 18 is attached to the inner liner 16 and is spaced apart from the outer sleeve 12 and an insulation layer 20*b* which is attached to the outer sleeve 12. The elastic band 18 is attached to the inner liner 16 by the inside seam 19 which is used to fix the elastic band 18 to the inner liner 16 in the wrist area 300, 450 of the sleeve 10 at a distance 400 away from the hand opening 15. The distance 400 may be based on the size (e.g., large, medium, small, etc.) of the garment 100. The second insulation layer 20*a* can be added between the elastic band 18 and the inner liner 16 to provide a soft feeling to the wearer when the inner liner 16 is drawn into contact with the wearer's skin.

While particular elements, embodiments and applications of the present disclosure have been shown and described, it will be understood, that the scope of the disclosure is not limited thereto, since modifications can be made by those skilled in the art without departing from the scope of the present disclosure, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another, or may be combined in various ways. All possible combinations and subcombinations are intended to fall within the scope of this disclosure. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this disclosure are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the disclosure.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The example calculations, simulations, results, graphs, values, and parameters of the embodiments described herein are intended to illustrate and not to limit the disclosed embodiments. Other embodiments can be configured and/or operated differently than the illustrative examples described herein.

What is claimed is:

1. A sleeve for a garment, comprising:

an outer panel attached along respective side edges thereof to form an outer sleeve having an upper end and a lower end;

an inner panel attached along respective side edges thereof to form an inner liner of the sleeve, the inner liner having an upper end and a lower end, the lower ends of the outer sleeve and the inner liner forming a hand opening;

at least one insulation layer; and, an elastic band attached to the inner liner proximate a wrist area of the sleeve and at a distance away from the hand opening, the elastic band being spaced apart from the outer sleeve;

wherein the at least one insulation layer is positioned between the elastic band and the inner liner;

wherein the upper end of the outer sleeve and the upper end of the inner liner extend to an arm opening of the garment;

wherein the elastic band is positioned between the inner liner and the outer sleeve; and, wherein the lower end of the outer sleeve and the lower end of the inner liner are attached along respective periphery edges at the hand opening.

2. The sleeve of claim 1, wherein the elastic band is attached to the inner liner without cutting the inner liner.

3. The sleeve of claim 1, wherein the inner liner comprises an inside seam to attach and fix the elastic band to the inner liner, the inside seam fixing the elastic band to a wrist area of the inner liner.

4. The sleeve of claim 1, wherein the outer sleeve has no seam encircling the elastic band.

5. The sleeve of claim 1, further comprising at least one additional insulation layer.

6. The sleeve of claim 5, wherein the at least one additional insulation layer is positioned between the elastic band and the outer panel.

7. The sleeve of claim 1, wherein the garment is an outerwear garment.

8. The sleeve of claim 1, wherein the garment is a jacket.

9. The sleeve of claim 1, wherein, when worn, the elastic band draws the inner liner into contact with and hug a wrist area of a wearer while the outer sleeve is undisturbed, not being drawn toward the wrist area of the wearer, and loosely fitted around the wrist area of the wearer.

10. The sleeve of claim 1, wherein the outer sleeve and the inner liner are unattached between respective periphery edges at the hand opening and respective upper ends at the arm opening.

* * * * *